US006197431B1

(12) United States Patent
Cox et al.

(10) Patent No.: US 6,197,431 B1
(45) Date of Patent: Mar. 6, 2001

(54) COMPOSITE MATERIAL MACHINING TOOLS

(75) Inventors: Jimmy Arthur Cox, Clemmons; Herman Carter Denny, Rural Hall, both of NC (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/099,208

(22) Filed: Jun. 18, 1998

Related U.S. Application Data

(60) Provisional application No. 60/050,300, filed on Jun. 20, 1997.

(51) Int. Cl.[7] ..... B22F 7/02; B22F 3/12

(52) U.S. Cl. ..... 428/548; 428/547; 419/5; 419/8; 419/26

(58) Field of Search ..... 419/5, 8, 26, 28; 428/548, 547

(56) References Cited

U.S. PATENT DOCUMENTS

| | | | | |
|---|---|---|---|---|
| 4,398,952 | * | 8/1983 | Drake | 419/18 |
| 4,630,692 | * | 12/1986 | Ecer | 175/330 |
| 4,669,522 | * | 6/1987 | Griffin | 164/97 |
| 4,731,115 | | 3/1988 | Abkowitz et al. | 75/236 |
| 4,852,531 | | 8/1989 | Abkowitz et al. | 123/188 AA |
| 5,333,520 | * | 8/1994 | Fischer et al. | 76/108.2 |

OTHER PUBLICATIONS

Dynamet Technology, Inc., Eight A Street, Burlington, MA, *Innovative Engineered Materials–Creative Manufacturing Technology*, pp. 1–8.

Dynamet Technology, Inc., Eight A Street, Burlington, MA, P/M Titanium Matrix Compposite: From, War Games to Fun & Games, *Titanium '95*, vol. III, pp. 2722–2730.

* cited by examiner

*Primary Examiner*—Ngoclan Mai
(74) *Attorney, Agent, or Firm*—Eckert Seamans Cherin & Mellott, LLC

(57) ABSTRACT

A method for manufacturing machining tools out of composite powdered metal which is first formed to approximate the desired shape of the machining tool; then bonded metallurgically; and machined to the desired finished shape. Desirably, the forming step employs at least two distinct powdered metals, the first formed to the outer shape over the portion of the tool that interfaces with the work piece and selected to exhibit the desired hardness and wear-resistance properties. The second material supports the hollow form of the first material and includes a shank to interface with the machine that the tool will be employed with. The second material is chosen to exhibit the desired ductility, surface hardness, abrasion resistance and reduced cost. Additional materials can be used for different facets of the tool to obtain an optimum balance of long life, efficient operation and low cost.

17 Claims, 3 Drawing Sheets

COMPOSITE MATERIAL MACHINING TOOLS

PRIORITY

This application claims the priority date of Provisional Application No. 60/050,300 filed Jun. 20, 1997.

BACKGROUND OF THE INVENTION

1. Field of the Invention

The present invention relates in general to machining tools and, more particularly, to machining tools that can benefit from being constructed out of exotic and expensive metals to improve their performance.

2. Background Information

The prior art method of manufacturing a machining tool, and more particularly, a machining tool that has to operate in a caustic environment, is to begin with bar stock of a material appropriate to withstand the environment, for example, an alloy sold by Crucible Steel known as M-42 or other similar alloys with a desired characteristic known generally as high speed steels, and machine away material as necessary to obtain the desired outer geometry of the cutting tool. This process is very costly since the machining operations are time consuming and involve the removal and waste of a large amount of the original, expensive, bar stock material.

SUMMARY OF THE INVENTION

Accordingly, one object of this invention is to provide a high speed machining tool and process for making the same which is less costly. Another object of this invention is to provide such a tool with improved operating characteristics that match or exceed those of prior art tools. Furthermore, among others, it is an object of this invention to provide such a tool requiring less manufacturing time. These and other objects are accomplished by manufacturing the improved machining tool of this invention from powdered metal which is formed into a preselected shape approximating the desired shape of the machining tool; bonding the powdered-metal in the preselected shape; and machining the preselected shape to achieve the desired machining tool. Preferably, the powdered metal is metallurgically bonded to achieve intergranular adhesion. In addition, it is preferable to employ two or more different types of powdered metals wherein the different metal types are located at predetermined portions of the preselected shape of the rough machining tool work piece with the characteristics of each metal chosen to best meet the demands of the portions of the tool that they are located at.

In one preferred embodiment, the outer machining surface of the tool that interfaces with the work piece is formed from a high speed alloy, e.g., CPM-42 while the interior of the tool and shank is formed from a second alloy having a significantly reduced cost, but exhibiting the necessary properties of ductility, surface hardness and abrasion resistance.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
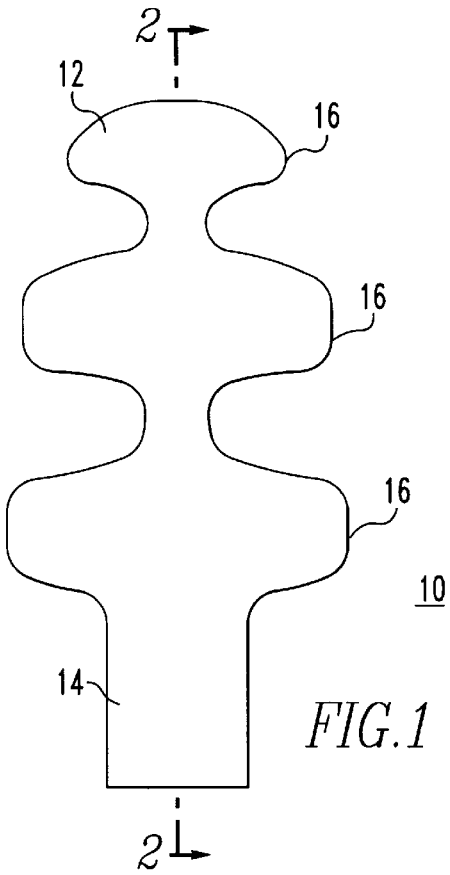
FIG. 1 is a perspective view of a rendering of a high speed machining tool constructed in accordance with this invention.
Figure 2:
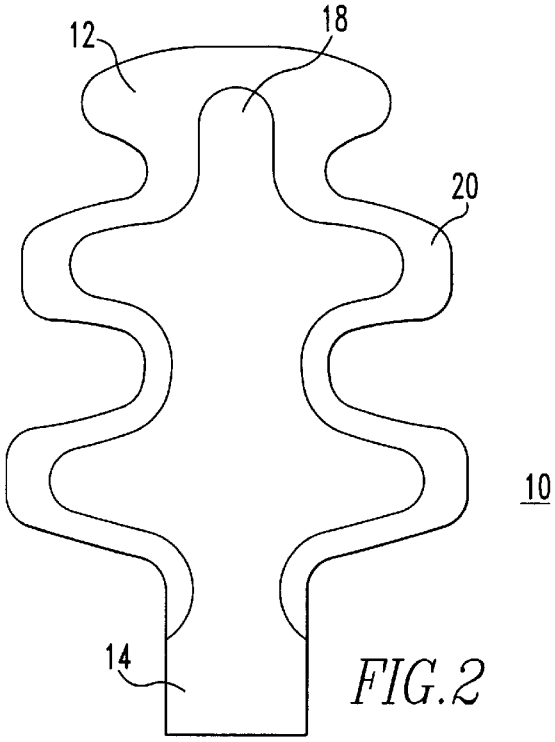
FIG. 2 is a cross-sectional view of the high speed cutting tool of FIG. 1 taken along the lines 2—2 thereof.

FIGS. 1 and 2 illustrate, in very general terms, a high speed tool 10 built in accordance with this invention. The tool 10 has an upper working portion 12 and a lower shank portion 14. The working portion 12 of the tool 10 contains a plurality of cutting edges 16 which are used to cut and to remove material from the work piece (not shown) during a high speed machining operation as is well known in the art. The shank portion 14 of the tool 10 is used to mount and anchor the tool 10 in a milling machine (not shown) during the machining operation. The outer surface geometry of the tool 10 is only one of many possible shapes of high speed cutting tools which can be formed in accordance with this invention. In addition, this invention is not limited to cutting tools, but can be applied to any machining tool, e.g., broaches.

FIG. 2 is a cross-sectional view of the cutting tool 10 as viewed along section lines 1A—1A of FIG. 1. As can be seen in FIG. 2, the shank portion 14 and an inner core portion 18 are formed from a first material while the outer cutting surface portion 20 is formed from the second material. Advantageously, the outer cutting surface portion 20 is formed from a high speed material, such as CPM-42 (composite powdered metal) or other composite powdered metal having the desired cutting properties, while the shank portion 14 and the inner core portion 18 are formed from a lower cost alloy material with different properties needed to address the function performed by these latter two tool portions. In other embodiments, the shank portion 14 and inner core portion 18 may be formed from different materials, or tools having other outer shapes may be formed from a variety of different materials, wherein each portion of a tool is formed from a material having specific desired characteristics for the component portion the material addresses.

Powder metallurgy involves the processing of metal powders. One of the major advantages of powder metallurgy is the ability to shape powders directly into a final component form. Using powdered metallurgy techniques, high quality, complex parts may be economically fabricated. There are also other reasons for using powdered metallurgy techniques. Properties and microstructures may be obtained using powdered metallurgy that cannot be obtained by alternative metal-working techniques. Among these microstructures are included oxide dispersion strengthened alloys, cermets, cemented carbides, and other composite materials. A further understanding of the use of powdered metallurgical materials in manufacturing processes can be found in U.S. Pat. No. 4,731,115, issued Mar. 15, 1988 and U.S. Pat. No. 4,852,531, issued Aug. 1, 1989.

In accordance with this invention, the preferred method of manufacturing the tool 10 shown in FIGS. 1 and 2 is to utilize powdered metal technology. The desired metal is provided in powdered metal form. The powdered metal is then shaped into a predetermined form by a casting or molding process more fully described in a pamphlet published by Dynamet Technology, Inc., Eight A Street, Burlington, Massachusetts, entitled "*Innovative Engineered*

*Materials-Creative Manufacturing Technology"*, and the article "*P/M Titanium Matrix Composites: From War Games to Fun & Games", Titanium* '95, Vol. III, pp. 2722–2730. This molded mixture of powdered metal is then bonded into a single solid preformed shape through a sintering process. Additional forging steps may be used to reduce the porosity of the preformed shape.

Figure 3:
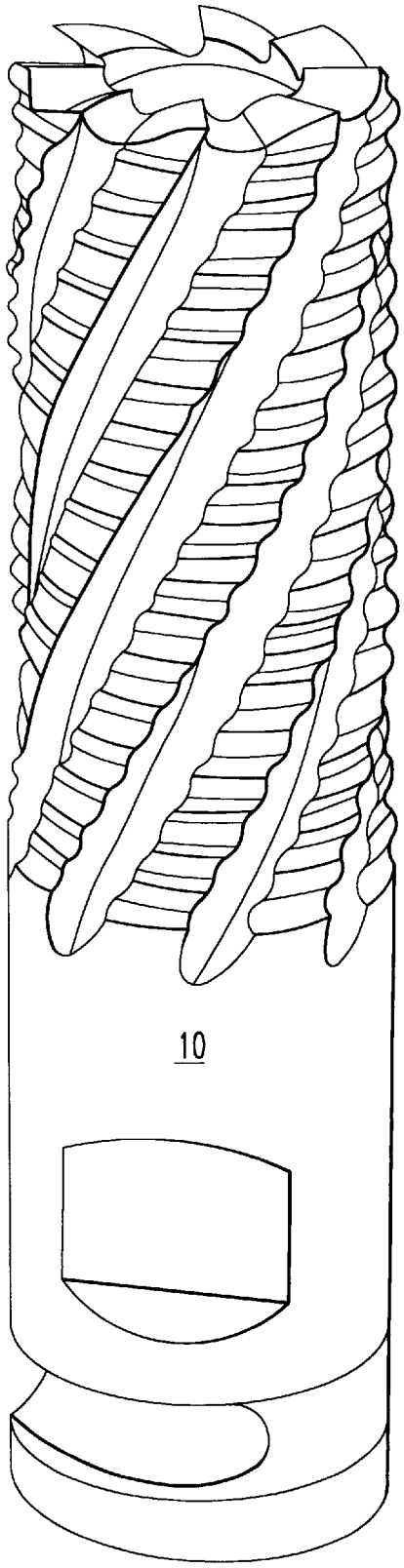
FIG. 3 is a perspective view of a cutting tool to which this invention can be applied.
Figure 5:
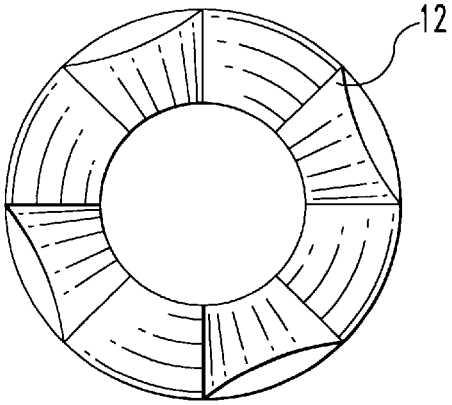
FIG. 5 is a top view of FIG. 3.
Figure 4:
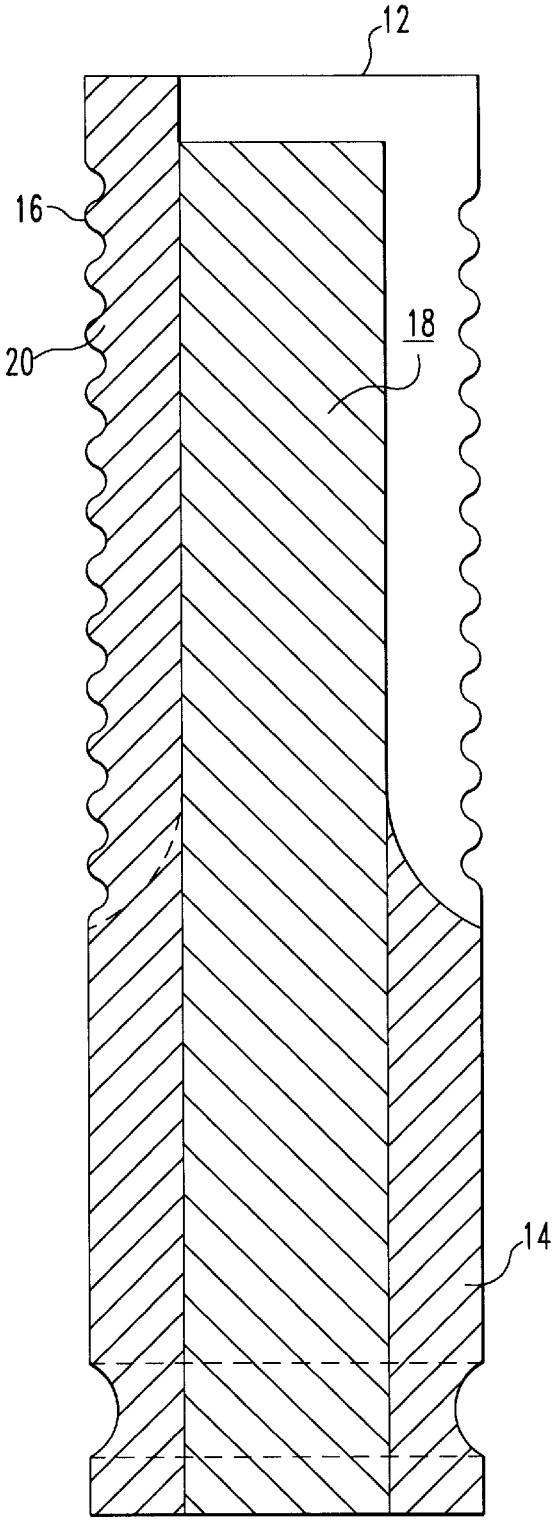
FIG. 4 is a cross sectional view of FIG. 3.

In a method in accordance with this invention, powdered CPM-42 metal is formed into a preformed shape which approximates the desired final outer shape of the tool 10. The preform is then machined into the exact shape required for the tool 10. Following this method, a minimum of material is removed during the machining process, since the preformed shape can be made to closely proximate the geometry of the final product. As a result, the cost of machining the tool 10 to the desired shape is reduced and the amount of waste material generated in the machining process is reduced when compared to the prior art method of manufacturing a high speed machining tool such as a high speed cutting tool. An example of such a tool is more fully illustrated in the perspective view shown in FIG. 3; with the corresponding cross-sectional view shown in FIG. 4; and a top view presented in FIG. 5. Like reference characters are used among the several views to designate corresponding parts.

The method of this invention can be further refined by using a plurality of different metal powders when forming the preformed shape. In one such method, a relatively lower cost alloy steel, such as ASTM 4140, is used to form the lower shank portion 14 and the inner core portion 18 of the cutting tool 10, while a more expensive high speed cutting steel, such as CPM-42, is used to form the outer cutting surface portion 20. The outer cutting surface portion is approximately ⅛ inch (0.318 centimeters) thick. The particular powder material used for the outer cutting surface portion 20 is preferably selected to have the desired properties such as hardness and wear resistance. The powdered material used for the inner core portion 18 and lower shank portion 14 is preferably selected to have the desired properties for the functions those elements serve, such as ductility, surface hardness, abrasion resistance and low cost. Other embodiments of the method of this invention may use more than two different powdered materials to form a plurality of portions of the machining tool, with the properties and locations of the particular materials selected to provide the desired performance.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of manufacturing a machining tool, comprising the steps of:

forming a powered metal into a preformed shape which approximates the desired shape of the machining tool by forming a first powdered metal, comprising a first alloy, into a first preformed shape which has an outer surface that approximates a first portion of the desired shape of the machining tool and a hollow interior, wherein the thickness of the first performed shape approximates ⅛ inch (0.318 centimeters);

forming a second powdered metal, comprising a second alloy, to fill at least a substantial portion of the hollow interior of the first powdered metal shape;

bonding the powdered metal in the preformed shape wherein the bonding step bonds the first and second powder metals, respectively, each to itself and at their interface to each other; and machining the preformed shape to achieve the desired shape.

2. The method of claim 1, wherein the second powdered metal forming step shapes the second powdered alloy to fill at least a substantial portion of the hollow interior of the first powdered metal shape and approximate a second portion of the desired shape of the machining tool.

3. The method of claim 1 wherein the second powdered metal is shaped to substantially fill the hollow interior of the first powdered metal shape.

4. The method of claim 1 wherein the first alloy covers the active machining surface of the tool and the second alloy supports the interior of the tool and forms a shank which interfaces with a machine that drives the tool.

5. The method of claim 4 including steps of:

selecting the first alloy to match the desired properties of the machining surface of the tool; and selecting the second allow to match the desired properties of the shank and support properties of the tool.

6. The method of claim 5 wherein the first alloy is selected because of its hardness and wear resistance properties.

7. The method of claim 6 wherein the first alloy if CPM-42.

8. The method of claim 5 wherein the second alloy is selected because of its ductility, surface hardness, abrasion resistance and reduced cost.

9. The method of claim 8 wherein the second alloy is ASTM 4140.

10. The method of claim 1 wherein the forming step is achieved with a casting process.

11. The method of claim 1 wherein the forming step is achieved with a molding process.

12. The method of claim 1 wherein the forming step comprises:

forming a plurality of three or more different powered metals into a preformed shape which approximates the desired shape of the machining tool, wherein each of said powered metals is located at a predetermined portion of said preformed shape; and wherein the bonding step bonds the plurality of powder metals, respectively, each to itself and at their interface to each other.

13. The method of claim 12 wherein the bonding step comprises sintering.

14. A machining tool formed by the process of claim 1.

15. A machining tool formed by the process of claim 12.

16. A method of manufacturing a machining tool, comprising the steps of:

forming a powered metal into the preformed shape which approximates the desired shape of the machining tool by:

forming a first powdered metal, comprising a first alloy, CPM-42, into a first preformed shape which has an outer surface that approximates a first portion of the desired shape of the machining tool covering the active machining surface of the tool, and a hollow interior;

forming a second powered metal, comprising a second alloy, to fill at least a substantial portion of the hollow interior of the first powdered metal shape;

bonding the powered metal in the preformed shape wherein the bonding step bonds the first and second powder metals, respectively, each to itself and at their interface to each other; and machining the preformed shape to achieve the desired shape.

17. The method of claim 16 wherein the second alloy is ASTM 4140.

* * * * *